United States Patent [19]

Bryant, Jr. et al.

[11] 4,235,251

[45] Nov. 25, 1980

[54] STABILITY OF TOBACCO CASING SYSTEMS CONTAINING PALLADIUM

[75] Inventors: Herman G. Bryant, Jr., Durham; James F. Bullock, Creedmoor; Robert G. Honeycutt, Rougemont, all of N.C.

[73] Assignee: Liggett Group Inc., Montvale, N.J.

[21] Appl. No.: 13,574

[22] Filed: Feb. 21, 1979

[51] Int. Cl.[3] ..... A24B 15/42

[52] U.S. Cl. ..... 131/140 B

[58] Field of Search ..... 131/140 C, 17 R, 2, 131/140 B, 15 R

*Primary Examiner*—V. Millin

*Attorney, Agent, or Firm*—J. Bowen Ross, Jr.

[57] ABSTRACT

The stability of palladium in tobacco casing systems is improved by the incorporation of a polysaccharide protective colloid.

12 Claims, No Drawings

STABILITY OF TOBACCO CASING SYSTEMS CONTAINING PALLADIUM

This invention relates to an improved method for preparing smoking compositions comprising tobacco and having associated therewith palladium as a catalytic agent. More particularly, the present invention is concerned with the use of a protective colloid to improve the stability of dispersions of palladium in casing systems used to case, flavor, and deposit palladium on the tobacco.

The subject matter of this invention is related to the subject matter of U.S. Pat. No. 4,055,191, granted Oct. 25, 1977; U.S. Application Ser. No. 763,267, filed Jan. 27, 1977; U.S. Application Ser. No. (Our Ref. : Case 220-2A) filed on even date herewith, a continuation-in-part of Ser. No. (Our Ref. : Case 294) filed on even date herewith.

As summarized in U.S. Pat. No. 4,055,191, the proportion of polyclic aromatic hydrocarbons (PCAH) in the smoke from the combustion of a natural leaf tobacco can be materially reduced by incorporating palladium in the smoking tobacco composition. It is further disclosed that palladium in combination with a nitrate salt, preferably magnesium nitrate, is even more efficient in reducing PCAH. Moreover, the smoke condensate collected from the smoke of cigarettes composed of tobacco treated with palladium and a nitrate salt exhibit a substantially reduced biological activity when evaluated on experimental animals according to conventional protocol.

In the manufacture of cigarettes composed of tobacco treated with palladium it has been found that the most efficient and convenient means of applying the palladium to the tobacco is to premix the palladium with the casing solution and apply this mixture to the tobacco according to conventional methods. The practicalities of the commercial production of cigarettes from cased tobaccos very often necessitate the storage of the casing solution for extended periods at relatively high temperatures before its application to the tobacco. In view of the high cost of palladium in today's world market the need to maintain the palladium effectively dispersed throughout its application and storage periods is of extreme importance.

In the practice of the present invention the stability of "insoluble palladium" in conventional casing solutions has been improved by the incorporation of a protective colloid of the polysaccharide family in the casing system. More particularly, it has been found in accordance with this invention that the settling losses of palladium in aqueous casing systems is minimized in vessels and pipes during storage and production down times by the addition to the casing system of a polysaccharide material selected from the groups of natural gums and the alkyl, hydroxy alkyl ethers and ester derivatives of cellulose and the alkali metal salts thereof.

Accordingly, it is an object of this invention to provide an improved method for the manufacture of smoking tobacco compositions containing palladium.

Another object of this invention is to provide a more efficient method for depositing palladium on a smoking tobacco.

A further object of the present invention is to provide a method for improving the stability of aqueous dispersions, including but not limited to tobacco casing systems, of palladium and its various salts.

More specifically, an object of this invention is the provision of a method for improving the stability of metallic palladium dispersions in conventional tobacco casing systems.

The polysaccharide gums suitable for use in the practice of the present invention are the natural, translucent, amorphous bodies exuded by trees and other plants. Illustrative of these natural gums are Guar, Agar, Algin, Karaya, Guaiac, Ghatti, Tragacanth, and Arabic and mixtures thereof. The other suitable polysaccharide materials include the lower alkyl and hydroxy lower alkyl ether and ester derivatives of cellulose and their alkali metal salts, such as methyl cellulose, hydroxy alkyl cellulose and sodium carboxymethyl cellulose. Preferably the polysaccharide material is a natural gum, most preferably gum tragacanth.

The polysaccharide materials contemplated for use in the present invention are used in concentrations of from about 0.10 to about 1.0 percent by weight, preferably from about 0.2 to about 0.6 percent, of the weight of casing applied to the tobacco. This is equivalent to a concentration of about 0.005 to about 0.1 percent by weight of the polysaccharide material on the cased tobacco.

Though the subject invention may be used in the manufacture of any tobacco composition which has had from 0.001% to about 1% by weight of palladium deposited thereon, it has found particular utility when used in the preparation of those tobacco compositions and methods described in U.S. Pat. No. 4,055,191 to Vello Norman and Herman G. Bryant and U.S. Application Ser. No. 13,575, filed on even date herewith by H. G. Bryant, P. F. Collins and J. O. Pullman. The complete disclosures of U.S. Pat. No. 4,055,191 and Application Ser. No. 13,575, are incorporated herein by reference.

The present invention is applicable to any conventional aqueous casing system which is used to apply humectants, binders, flavorants and any other additives to the tobacco. The casing system with its various additives is normally applied to the tobacco in a mixing cylinder at elevated temperatures. The mixture of tobacco and casing material is then bulked, compressed, cut and then dried to the desired moisture content. This final tobacco product at an equilibrated moisture level is what is meant by "cased tobacco" as used herein. Preferably the casing system should not contain any additive which interferes with the interaction of the palladium compound and the reducing agent used to form the "insoluble palladium" hereinafter defined. The present invention has found particular utility in those instances where the amount of "insoluble palladium" in the casing is greater than fifty percent by weight of the total palladium in the casing. Though any accurate method for determining the amount of palladium may be used the procedure of O. Menis and T. C. Rains, "Colorimetric Determination of Palladium With Alpha-Furildioxime," Anal. Chem., 27, 1932–34 (1955) has been found to be suitable for determining "total" and "insoluble" palladium.

The palladium may be incorporated into the aqueous casing systems for application onto the tobacco in finely divided metallic form, for example palladium black, and/or in the form of a salt which is decomposable in situ, preferably by heat, into metallic palladium. Water-soluble palladium salts are preferred because they are readily soluble in the casing system and more evenly incorporated into and distributed throughout the tobacco composition. Illustrative examples of suitable palladium salts include simple salts such as palladium nitrate, palladium halides such as palladium chloride, diammine complexes such as palladous dichlorodiammine ($Pd(NH_3)_2Cl_2$), and palladate salts, especially ammonium salts such as ammonium tetrachloropalladate and ammonium hexachloropalladate. One form of palladium which has been found to be particularly effective in combination with tobacco to provide the smoking composition of this invention is ammonium hexachloropalladate, $(NH_4)_2PdCl_6$ (Research Organic-Inorganic Chemicals Corp.), 99.5% pure.

The palladium added to the casing system is in amounts sufficient to yield on the final cased tobacco a concentration of metallic palladium of between 0.001% to about 1%, preferably 0.01% to about 0.1% by weight of the cased tobacco.

Another embodiment of the present invention contemplates the deposition onto tobacco of palladium in combination with an inorganic nitric oxide generating compound. Illustrative of the nitric oxide compounds which are added to the casing system with the palladium in accordance with the present invention are the nitrate salts of metals of Groups Ia, Ib, IIa, IIb, IIIa, IIIb, IVa, IVb, Va, Vb, and the transition metals of the Periodic Table. The particular nitrate salt chosen for use in the practice of the present invention is one which is deemed to be non-toxic when present in the smoking compositions of the present invention.

Illustrative of the various nitrate salts which are suitable for use, from a toxicity standpoint, in the practice of the present invention are the nitrates of lithium, sodium, potassium, rubidium, cesium, magnesium, calcium, strontium, yttrium, lanthanum, cerium, neodymium, samarium, europium, gadolinium, terbium, dysprosium, erbium, scandium, manganese, iron, rhodium, palladium, copper, zinc, aluminium, gallium, tin, bismuth, hydrates thereof and mixtures thereof. Preferably, the nitrate salt is an alkali or alkaline earth metal nitrate. More preferably, the nitrate is selected from the group of calcium, magnesium and zinc with magnesium nitrate being the most preferred salt. A magnesium nitrate which has been particularly effective in combination with palladium and tobacco to provide the smoking composition of this invention is A.C.S. grade $Mg(NO_3)_2.6H_2O$ which contains (on a weight basis) less than about 0.0005% chloride ion, 0.005% ion and 0.0004% heavy metals (calculated as lead).

The desired concentration of nitrate in the tobacco composition may also be achieved by the use of smoking tobaccos which naturally contain relatively high concentrations of nitrate in the tobacco. Illustrative of the tobaccos possessing a high concentration of native nitrate and which are useful in the practice of the present invention are the various burley tobaccos, such as those that originate in Germany, Japan and the United States; certain Turkish tobaccos, such as those that originate in the USSR and Bulgaria; the Maryland tobaccos; and blends thereof with or without the various grades of the bright tobaccos.

Another means of increasing the native nitrate content of the tobacco blend involves the use of the processed lower lug portions of the tobacco plant. For instance, increasing the content of tobacco burley stems in the final blend would result in an increase in the native nitrate content of the blend.

A list of the various tobaccos and their native nitrate content can be found in the *Tobacco and Tobacco Smoke Studies in Experimental Carcinogenesis,* by Ernest L. Wynder and Dietrich Hoffman, Academic Press 1967, the disclosure at pages 453–458 of which is incorporated herein by reference.

In the practice of the present invention, the proportion of nitrate added to the casing system or naturally occurring in the tobacco is an amount sufficient to yield a concentration below 0.8%, and preferably in the range of from about 0.25 weight percent to about 0.75 weight percent, calculated as native or added nitrate nitrogen, of the total tobacco or tobacco blend. It is preferred to operate in the range of from about 0.50 to about 0.80 percent total nitrate nitrogen whether in the form of added nitrate salt or native to the tobacco. These same concentrations apply when the inorganic nitric oxide generating compound is an inorganic nitrite salt.

In addition the present invention contemplates the use of an added inorganic nitrate or nitrite salt, or naturally occurring native nitrate, or mixtures thereof in combination with palladium in a tobacco composition.

In those instances wherein the entire or predominant portion of the nitrate component of the tobacco compositions of the present invention are naturally occurring in the tobaccos, i.e. native nitrate, it has been found that the addition of a water soluble magnesium salt maybe desirable. The magnesium salt can be inorganic or organic provided it is non-toxic. Illustrative of these salts are magnesium oxalate, magnesium citrate, magnesium chloride, etc. The magnesium is added in amounts sufficient to adjust the concentration of magnesium in the final tobacco blend in the range of from about 0.5 to about 1.0 weight percent.

In those instances where the palladium starting material is a water soluble palladium salt, it has been found desirable to apply the palladium and its carrier medium after the "soluble palladium" in the carrier medium has been reduced to not more than 5 percent of the total palladium. The carrier medium in most instances will be the casing mixture. The insolubilization of the palladium in an aqueous medium is achieved by the addition of a reducing agent capable of reducing the soluble palladium ions to "insoluble palladium". This insolubilization of the palladium is best achieved at temperatures of from about 50° C. to about 90° C. in a solution having a pH of no more than 3 and by the use of a sugar and/or polyhydroxy compound as the reducing agent as described in Application Ser. No. (Our Ref.: Case 294), by H. G. Bryant, et.al., filed on even date herewith the disclosure of which is incorporated herein by reference.

"Soluble palladium" as used herein can be defined as palladium in an aqueous mixture which when the mixture is diluted with water and filtered through a membrane filter with 0.45$\mu$ pores, appears in the filtrate. The palladium which is retained on the filter is defined as "insoluble palladium". The chemical form of this "insoluble palladium" has been found to be predominantly, if not completely, metallic palladium. The chemical form of the "soluble palladium" is considered to be essentially all ionic, based on available evidence. Though the precise forms of soluble and insoluble palladium have not been conclusively established, the present invention is intended to extend to "insoluble palladium"formed in the manner described, regardless of the precise chemical and physical form of the palladium.

The present invention is of particular utility in those casing systems where it is desirable to have high concentrations of insoluble palladium. The insolubilization of palladium occurs very slowly at ambient temperature, and excessively long periods of time are required to achieve practical conversions of the soluble palladium to insoluble palladium. Consequently, to achieve practical rates of conversion the solution is heated at elevated temperatures, with the rate of formation of insoluble palladium increasing with increasing temperature. However, as the temperature increases, the insoluble palladium tends to form agglomerates of insoluble palladium which presents difficulties in obtaining uniform distribution of the metal. The use of the polysaccharide materials according to the present invention inhibit the formation of agglomerates of palladium thereby providing for a more uniform distribution of the palladium in the casing mixture.

The following examples are set forth to be illustrative of certain preferred embodiments and not to limit the scope of the present invention.

The casing formulas of the examples reported in the following table were prepared by premixing the polysaccharide material with the glycerine then adding the other casing ingredients with constant stirring. The magnesium nitrate should be added prior to the aqueous solution of the palladium salt which is the last ingredient to be added to the casing system. The casing mixture was stirred and heated at 77° C. for five hours. The casing mixture was then removed from the heat source and left undisturbed except for periodically withdrawing 0.2 cc samples at depths of 0.5 inches below the surface of the casing mixture. These removed samples were then analyzed for total palladium. The samples were analyzed for total palladium by weighing the removed sample and adding 5 to 10 ml of a 1:1 volume mixture of nitric and perchloric acids and analyzing for palladium by atomic absorption spectroscopy and the results reported in the following Table. Any procedure for accurately measuring the quantity of palladium in the obtained samples may be used.

TABLE

| Example | 1 | 2 | Control |
|---|---|---|---|
| Casing Formula wt. % | | | |
| Glycerine | 5.03 | 5.03 | 5.03 |
| Invert Sugar | 25.53 | 25.53 | 25.53 |
| Corn Syrup | 6.91 | 6.91 | 6.91 |
| Flavor | 5.32 | 5.32 | 5.32 |
| Gum Tragacanth | 0.20 | — | — |
| Sodium Carboxy Methyl Cellulose | — | 0.20 | — |
| $Mg(NO_3)_2 \cdot 6H_2O$ 5% by weight solution of | 31.86 | 31.86 | 31.86 |
| $(NH_4)_2PdCl_4$ | .94 | .94 | .94 |
| $H_2O$ | 24.21 | 24.21 | 24.21 |
| Stability of Pd, wt. % | | | |

TABLE-continued

| Example | 1 | 2 | Control |
|---|---|---|---|
| in sample | | | |
| 0 hours | 0.424 | 0.420 | 0.428 |
| 0.5 hours | 0.445 | 0.408 | 0.405 |
| 1.0 hours | 0.432 | 0.370 | 0.382 |
| 17 hours | 0.430 | 0.165 | 0.042 |
| 72 hours | 0.431 | 0.159 | 0.039 |

What is claimed is:

1. A method for the deposition of palladium on smoking tobacco comprising (a) adding palladium to an aqueous casing system which contains from about 0.25 to about 1.0 percent by weight of at least one polysaccharide compound selected from the group of natural gums and lower alkyl, hydroxy lower alkyl and lower alkoxy ethers and esters of cellulose, and (b) admixing the palladium containing casing system with tobacco to deposit thereon said palladium.

2. The method of claim 1 wherein the palladium is present in said casing system in amounts sufficient to yield on the cased tobacco a concentration of from about 0.001 to about 1 percent by weight of palladium.

3. The method of claim 2 wherein the palladium is present in said cased tobacco in an amount of from about 0.01 to about 0.10 percent by weight.

4. The method of claim 3 wherein the palladium is added to the aqueous casing system in the form of a water soluble compound.

5. The method of claim 4 wherein the soluble palladium compound is selected from the groups consisting of palladium nitrate, palladium chloride, palladous dichlorodiamine, ammonium tetrachloropalladate and ammonium hexachloropalladate.

6. The method of claim 4 wherein the casing system contains a water soluble inorganic nitrate salt in a concentration sufficient to yield on the cased tobacco of from about 0.25 to about 0.75 percent by weight of nitrate nitrogen.

7. The methods of claim 6 wherein the polysaccharide compound is a lower alkyl or hydroxy lower alkyl ether of cellulose and their alkali metal salts.

8. The method of claim 7 wherein the polysaccharide compound is sodium carboxymethyl cellulose.

9. The method of claim 6 wherein the nitrate salt is magnesium nitrate.

10. The method of claims 4 wherein the casing system is admixed with the tobacco after the "soluble palladium" has been reduced to not more than 5 percent by weight of the total palladium in the casing system.

11. The methods of claims 4, wherein the polysaccharide compound is a natural gum selected from the group consisting of guar, agar, algin, karaya, guaiac, ghatti, tragacanth and arabic gums.

12. The methods of claim 11 wherein the natural gum is tragacanth gum.

* * * * *